United States Patent [19]

Komori

[11] 4,381,455

[45] Apr. 26, 1983

[54] FLAME DETECTOR INCLUDING DETECTOR TESTING APPARATUS

[75] Inventor: Toshiyuki Komori, Fuchu, Japan

[73] Assignee: Tokyo Shibaura Denki Kabushiki Kaisha, Kawasaki, Japan

[21] Appl. No.: 267,605

[22] Filed: May 27, 1981

[30] Foreign Application Priority Data

Jun. 20, 1980 [JP] Japan ..... 55/82879

[51] Int. Cl.[3] ..... G06K 7/10

[52] U.S. Cl. ..... 250/554; 431/24

[58] Field of Search ..... 250/554, 577, 214 R; 431/24, 79, 18

[56] References Cited

U.S. PATENT DOCUMENTS 3,683,372 8/1972 Horn ..... 340/410

3,737,664 6/1973 Oldenburg et al. ..... 250/214 R

*Primary Examiner*—David C. Nelms

*Assistant Examiner*—J. Brophy

*Attorney, Agent, or Firm*—Finnegan, Henderson, Farabow, Garrett & Dunner

[57] ABSTRACT

A flame detector for monitoring the flame of a burner including an electrically actuatable photo shielding element positioned between a photoelectric element and the flame. The normally transparent photo shielding element may be turned opaque on command for simulating a no flame condition of the burner. The resulting signal from the photoelectric element is compared with a predetermined signal level, when there is actually no flame, for testing the flame detector.

8 Claims, 3 Drawing Figures

FLAME DETECTOR INCLUDING DETECTOR TESTING APPARATUS

BACKGROUND OF THE INVENTION

This invention relates to a flame detector, and more particularly, to a testing circuit used with such a detector. It is important to monitor many burners to determine whether there are flames or not by detecting the light variation of the flames. An abnormal condition will occur if the flame is extinguished and a photo sensor or an inner circuit of the flame detector is out of order. The abnormal condition is a spouting of unburned fuel from the burner which is not producing a flame. If the flame detector is out of order, despite the fact that no flame is being produced by the burner, the flame detector outputs a signal which permits fuel to continue to be provided to the burner. This situation is very dangerous. If the flame detector operates normally, it detects whether there is a flame from the burner or not and outputs a signal to stop providing one fuel to the burner, if there is no flame. Accordingly, it will prevent the abnormal condition under which fuel is wrongly provided to the burner.

Recently, many burners may be used in a larger boiler. An erroneous operation of the flame detector in such a case may produce a disastrous result.

The operation of the flame detector itself, therefore, must be monitored. Referring to FIG. 1, a previously known flame detector is shown, including a pivoted photo shielding plate 11 which may be interposed between a flame 12 from a burner 13 and a photo sensor 14 for detecting the light intensity of the flame 12. The photo shielding plate 11 blocks off the flame 12 and presents to the photo sensor 14 the same situation as if the flame had gone out. By blocking off the flame 12, the shield 11 can confirm that the flame detector is operating normally. If the shielding plate 11 properly blocks off the flame, an amplifier 15 transmits an amplified signal from the photo sensor 14 to a detecting circuit 16. The detecting circuit 16 reacts as if there is no flame. In the example of the pivotable shielding plate, the shielding plate 11, a rotary solenoid 17 and a power source 18 are used. A switch 19 is provided between the rotary solenoid 17 and the power source 18. When the switch 19 is closed, the shielding plate 11 moves to block off the flame 12.

However, it sometimes happens that the pivoted portion of the rotary solenoid 17 is out of order. Additionally, the plate 11 may become warped or otherwise defaced so that it does not completely block the light of the flame 12. This leakage of the light causes an error in the monitoring of the flame detector. A further problem arises when the rotary solenoid 17 pivots the shield plate 11 and an electric noise results which adversely affects other electronic circuits. Furthermore, the rotary solenoid 17 needs a power source 18 for driving it and a connecting conductor between the solenoid 17 and the source 18 through the switch 19.

SUMMARY OF THE INVENTION

It is an object of this invention to provide an improved flame detector which can be tested in its operation by using a photo shielding element. According to this invention, the flame detector comprises: a photoelectric element for detecting a light from a flame and producing a current; a photo shielding element for shielding the light of the flame from the photoelectric element when the photo shielding element is opaque and for permitting the photoelectric element to detect the light of the flame when the photo shielding element is transparent, the photo shielding element being electrically actuated to be opaque or transparent, means for converting the output current of the photoelectric element to a constant-current; a load for varying a terminal voltage thereof according to the constant-current, the load being applied to a power source through said constant-current; a testing signal circuit constituting a filter circuit for the power source; a switch for connecting the testing signal circuit to the power source, the switch being open to output a voltage containing a testing signal from the power source; a circuit for separating the testing signal from the output voltage of the power source when the testing signal circuit is separated while the switch is open; and a driver circuit for actuating said photo shielding element to be opaque according to the testing signal.

DETAILED DESCRIPTION OF THE INVENTION

Figure 2:
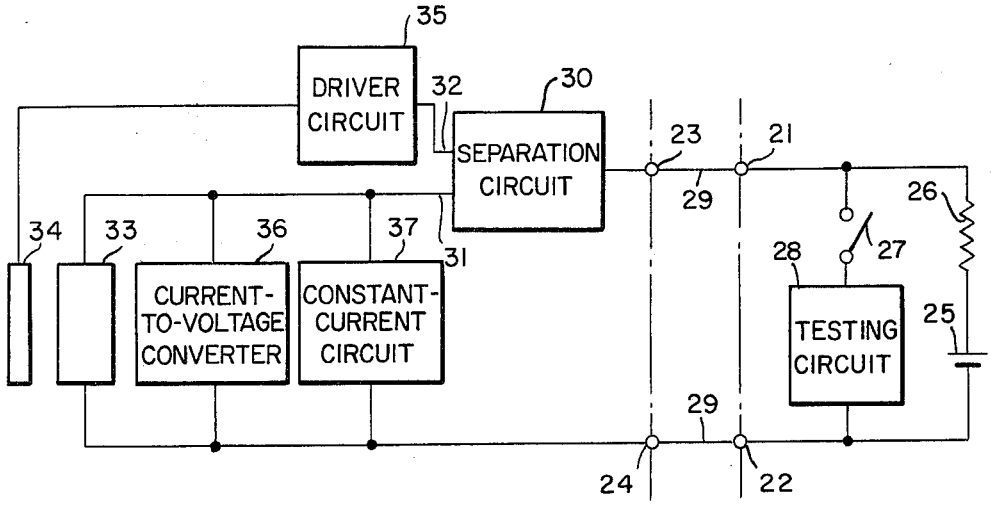
FIG. 2 is a block diagram showing one example of a flame detector according to this invention.

FIG. 2 is a block diagram showing one example of a flame detector according to this invention.

A monitoring station is shown on the right side of an imaginary line running between terminals 21 and 22, and a burner, located, for example, in a boiler, is shown on the left side of an imaginary line running between terminals 23 and 24. A series circuit including a DC power source 25 and a load 26 is connected across a series circuit of a switch 27 and a testing signal circuit 28. The terminal 21 is connected to the terminal 23 and the terminal 22 is connected to the terminal 24 by the conductors 29. The series circuit of the DC power source 25 and the load 26 is connected across the terminals 21 and 22. When the switch 27 is open, a testing signal outputs at the terminal 21.

A separation circuit 30 is connected to the terminal 23. This circuit 30 outputs a DC voltage at a first terminal 31 and outputs an AC voltage at a second terminal 32. An electrically actuated photo shielding element 34 is provided in front of a photo receptive portion of a photoelectric element 33 which detects a light of a flame from a burner (not shown). The photo shielding element 34 is, for example, a liquid crystal plate which shields or transmits the light of the flame according to an electric signal.

A driver circuit 35 is interposed between the separation circuit 30 and the liquid crystal plate 34. An electric signal from the driver circuit 35 is applied to the liquid crystal plate 34 according to the output signal from the second terminal 32 of the separation circuit 30. A current-to-voltage converter 36 amplifies an output signal of the photoelectric element 33 to a proper voltage signal level. A constant-current circuit 37 is interposed between the terminal 24 and the output terminal 31 of the separation circuit 30. The constant-current circuit 37 outputs a constant-current according to the output signal of the current-to-voltage converter 36.

Figure 3:
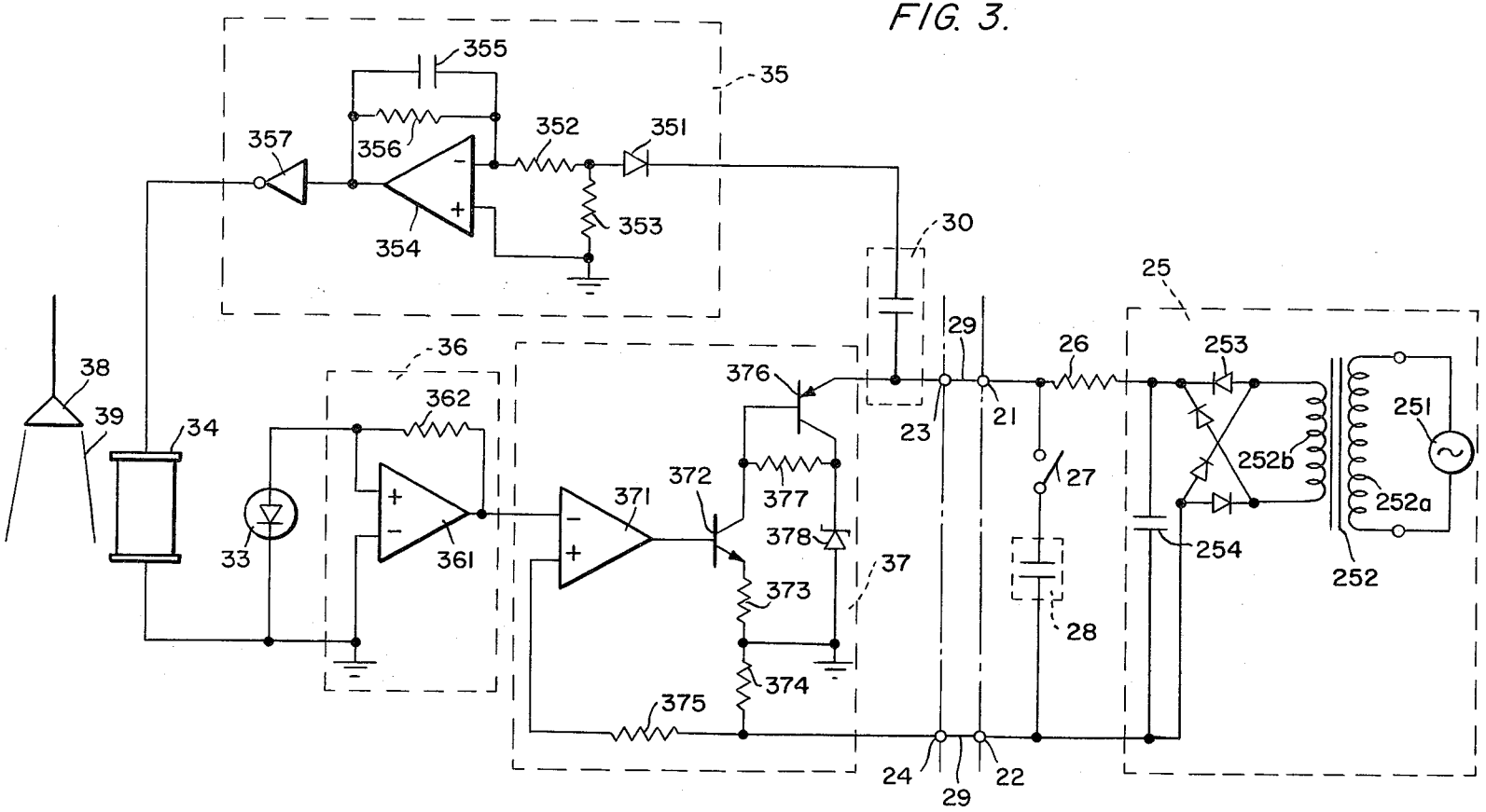
FIG. 3 is a circuit diagram according to FIG. 2.

FIG. 3 is a circuit diagram according to this invention. Referring to FIG. 3, this invention will be explained in detail. The DC power source 25 will be described hereinafter. An AC power source 251 is applied to a primary winding 252*a* of a transformer 252. A secondary winding 252*b* is connected across a rectifier 253 composed of four diodes. A capacitor 254 is connected across the output terminals of the rectifier 253.

One terminal of a resistor 26, as the load, is connected to one output terminal of the rectifier 253. Through a switch 27 a testing signal circuit 28, composed by a capacitor, is interposed between other terminal of the resistor 26 and other output terminal of the rectifier 253. The capacitor 254 and the resistor 26 act as a filter circuit to smooth the output voltage from the rectifier 253. Furthermore, the capacitor 28 smoothes the output voltage from the rectifier 253 when the switch 27 is closed. A DC voltage including a ripple signal is produced at the terminal 21.

The separation circuit 30 is connected to the terminal 23. The separation circuit 30 is composed of a capacitor. One terminal of the capacitor 30 is connected to the terminal 23. The other terminal of the capacitor 30 is connected to a cathode of a diode 351 in the driver circuit 35. A terminal of each of resistors 352 and 353 is connected to the anode of the diode 351. The other terminal of the resistor 352 is connected to the negative input of an operational amplifier 354. The other terminal of the resistor 353 is connected to the positive input of the operational amplifier 354 and is also grounded.

A parallel circuit of a capacitor 355 and a resistor 356 is interposed between the output and the negative input of the operational amplifier 354. The output of the operational amplifier 354 is connected to an input of an inverter circuit 357.

One terminal of the photo shielding element 34 is connected to an output of the inverter circuit 357. The photo shielding element, for example, as previously stated, a liquid crystal plate, transmits or blocks out the light according to an output signal of the driver circuit 35.

A burner 38 is located in front of the photo shielding element 34. A flame 39 is emitted from the burner 38.

The photoelectric element, for example, a photo diode 33, is provided at the output of the photo shielding element 34. The photoelectric element detects the light intensity of the flame 39.

The output current of the photoelectric element 33 is applied to the current-to-voltage converter 36. The current-to-voltage converter 36 is described hereinafter. The photoelectric element 33 is connected across the positive and negative inputs of an operational amplifier 361. The negative input of the operational amplifier 361 is also connected to other terminal of the photo shielding element 34 and is grounded. A resistor 362 is interposed between the positive input and the output of the operational amplifier 361.

The output signal of the current-to-voltage converter 36 is applied to the constant-current circuit 37. The output of the operational amplifier 361 is connected to the negative input of the operational amplifier 371. The output of the operational amplifier 371 is connected to a base of a transistor 372. One terminal of a resistor 373 is connected to an emitter of the transistor 372. The other terminal of the resistor 373 is connected to one terminal of the resistor 374. The other terminal of the resistor 374 is connected to the positive input of the operational amplifier 371 through a resistor 375. A connecting point of the resistors 373 and 374 is grounded. A connecting point of the resistors 374 and 375 is connected to the terminal 24.

A collector of the transistor 372 is connected to a base of a transistor 376. A resistor 377 is interposed between the base and a collector of the transistor 376. An emitter of the transistor 376 is connected to the terminal 23. The cathode of a zener diode 378 is connected to the collector of the transistor 376 and the anode of the zener diode 378 is grounded.

The operation of this example will now be described.

(a) In case of the detection of the light from the flame of the burner.

When the switch 27 is closed, the filter composed of the resistor 26, capacitors 254 and 28 is connected across the rectifier 253. A DC voltage containing very little ripple component is produced at the terminal 21. The capacitor 30 acting as the separation circuit, prevents the DC voltage from applying to the driver circuit 35. Accordingly, the output voltage of the operational amplifier 354 is zero. The input voltage of the inverter 357 is also zero, so that the inverter 357 outputs a voltage signal. This voltage signal is applied to the transparent photo shielding element 34. The photoelectric element 33 receives the light from the flame 39 of the burner 38 through the photo shielding element 34. The photoelectric element outputs a current according to the light intensity of the flame 39.

The operational amplifier 361 outputs a voltage of the product of the output current from the photoelectric element 33 and the resistance of the resistor 362. When the output voltage of the operational amplifier 361 is applied to the negative input of the operational amplifier 371, the transistor 372 becomes conductive. An emitter current of the transistor 372 flows to the resistor 374 through the resistor 373.

Since one terminal of the resistor 374 is grounded, a negative voltage is produced at other terminal of the resistor 374. This negative voltage is applied to the positive input of the operational amplifier 371 through the resistor 375. The operational amplifier 371 outputs a current until the voltage difference between the negative and the positive inputs of the operational amplifier 371 becomes zero. The emitter current of the transistor 372 flows through the resistor 373 according to the output current of the operational amplifier 371. That is, the varying emitter current of the transistor 372 is the varying collector current of the transistor 372. The varying collector current is the varying output current of the photoelectric element 33. That is, the varying output of the photoelectric element 33 is the varying light intensity of the flame 39 from the burner 38. The circuit composed of the transistor 376 and the resistor 377 prevents the collector of the transistor 372 from flowing excess current. The zener diode holds the terminal voltage of the transistor 372 and the resistor 373 to a constant voltage.

The varying collector current of the transistor 372 is the varying current of the resistor 26. The terminal voltage of the resistor 26 varies according to the current through the resistor 26. By monitoring the terminal voltage of the resistor 26, the light intensity of the flame 39 can be monitored.

(b) In case the testing signal is used when the switch 27 is open, the filter circuit of the rectifier circuit 253 is composed of the capacitor 254 and the resistor 26 but not the capacitor 28. Accordingly, the DC voltage contains the ripple signal as the testing signal at the terminal 21. This DC voltage containing the ripple signal is applied to the separation circuit 30. The separation circuit 30 separates the ripple signal from the DC voltage. That is, the component of the DC voltage is cut off by the separation circuit 30. Furthermore, the negative voltage of the ripple signal is produced at the anode of the diode 351.

The operational amplifier 354 is an inversion amplifier with the resistors 352 and 356, and is a filter circuit with the capacitor 355 and the resistor 356. This filter circuit has the time constant decided by the capacitance of the capacitor 355 and the resistance of the resistor 356.

Accordingly, the negative voltage of the ripple signal at the anode of the diode 351 is inverted to a positive voltage and amplified by the operational amplifier 354, and the output voltage of the operational amplifier is thereby converted to a smooth DC voltage. When this DC voltage is applied to the inverter circuit 357, the output voltage of the inverter circuit 357 is zero, and the photo shielding element 34 becomes opaque. Consequently, the photoelectric element 33 cannot detect the light of the flame 39 through the opaque photo shielding element 34.

If the output current of the photoelectric element 33 is zero, the output voltage of the current-to-voltage converter 36 is zero. Since the transistor 372 is non-conductive, the current of the load 26 is smaller than the normal current of the load. When the photoelectric element 33 detects the light of the flame 39, the normal current flows through the load 26. If the current of the load 26 becomes small, the terminal voltage of the load 26 also becomes small. If this terminal voltage of the load 26 is almost equal to a predetermined terminal voltage of the load 26 which is measured without the flame of the burner, the photoelectric element 33 and the electronic circuit, for example, the current-to-voltage converter 36 are decided to be normal.

Figure 1:
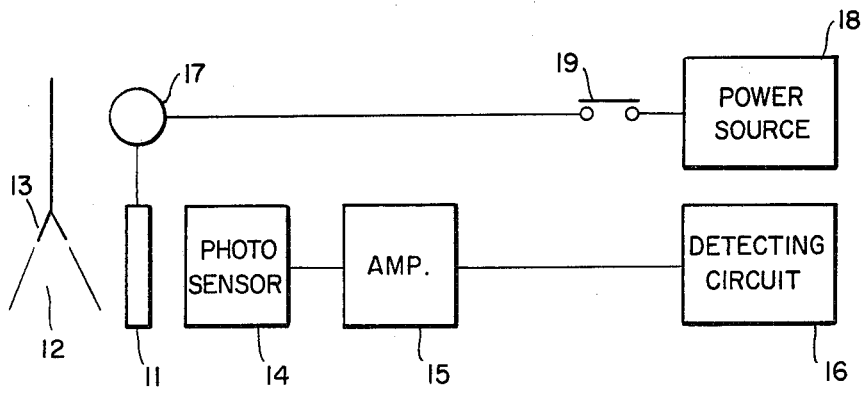
FIG. 1 is a block diagram showing a former flame detector.

If the burner 38 emits a flame, the shielding plate 34 is actuated to become opaque, and the terminal voltage of the load 26 does not change to a voltage substantially equal to the predetermined value, an abnormal condition exists. This indicates that the flame detector is out of order. Accordingly, by using the testing signal, if the photo shielding element 34 is opaque, the terminal voltage of the load 26 indicates whether the flame detector is out of order or not. By using the electrically actuated photoshielding element, the rotary solenoid 17, the secondary power source 18 and the connecting conductor between the rotary solenoid 17 and the power source as shown FIG. 1 of the former flame detector are eliminated. Furthermore, the electric noise of the rotary solenoid 17 is avoided.

What is claimed is:

1. A flame detector comprising:

a photoelectric element for detecting a light from a flame and producing a current; a photo shielding element for shielding the light of the flame from the photoelectric element when the photo shielding element is opaque and for permitting said photoelectric element to detect the light of the flame when said photo shielding element is transparent, said photo shielding element being electrically actuated to be opaque or transparent; means for converting said current of said photoelectric element to a constant-current; a load for varying the terminal voltage thereof according to said constant-current, said load being applied to a power source through said constant-current; a testing signal circuit constituting a filter circuit for said power source; a switch for connecting said testing signal circuit to said power source, said switch being open to output a voltage containing a testing signal from said power source; a circuit for separating the testing signal from the output voltage of said power source when said testing signal circuit is separated while said switch is open; and a driver circuit for actuating said photo shielding element to be opaque according to said testing signal.

2. A flame detector according to claim 1, wherein said photo shielding element comprises a normally transparent liquid crystal plate which is electrically actuatable to an opaque condition.

3. A flame detector according to claim 1, wherein said converting means includes a current-to-voltage converter and a constant current circuit and wherein said constant-current circuit comprises: an operational amplifier in which a voltage signal from said current-to-voltage converter is applied to the negative input thereof and a transistor for producing said constant-current according to said operational amplifier.

4. A flame detector according to claim 3, wherein said constant-current circuit further includes a resistor for producing a negative terminal voltage.

5. A flame detector according to claim 1, wherein said load comprises a resistor.

6. A flame detector according to claim 1, wherein said testing signal circuit comprises a capacitor.

7. A flame detector according to claim 1, wherein said circuit for separating comprises a capacitor.

8. A flame detector according to claim 3, wherein said circuit for driving comprises an operational amplifier to which said testing signal is applied; and an inverter circuit to which an output signal of said operational amplifier is applied.

* * * * *